US008472205B2

(12) United States Patent
Gondosch et al.

(10) Patent No.: US 8,472,205 B2
(45) Date of Patent: Jun. 25, 2013

(54) ADAPTIVE PRINTED CIRCUIT BOARD CONNECTOR

(75) Inventors: Robert Michael Philip Gondosch, Waterloo (CA); James Robert Bastow, Waterloo (CA)

(73) Assignee: Research In Motion Limited, Waterloo (CA)

( * ) Notice: Subject to any disclaimer, the term of this patent is extended or adjusted under 35 U.S.C. 154(b) by 137 days.

(21) Appl. No.: 12/982,152

(22) Filed: Dec. 30, 2010

(65) Prior Publication Data

US 2012/0171886 A1 Jul. 5, 2012

(51) Int. Cl.
*H01R 13/62* (2006.01)
*H01R 43/00* (2006.01)
*H01R 31/06* (2006.01)

(52) U.S. Cl.
USPC ..... 361/760; 361/683; 361/736; 361/773; 361/774; 429/100; 429/121

(58) Field of Classification Search
USPC ..... 439/951, 700, 824, 345, 628; 29/825
See application file for complete search history.

(56) References Cited

U.S. PATENT DOCUMENTS

| | | | | |
|---|---|---|---|---|
| 5,069,626 | A | 12/1991 | Patterson et al. | |
| 5,140,745 | A | 8/1992 | Mckenzie, Jr. | |
| 5,963,045 | A * | 10/1999 | Zink et al. | 324/750.16 |
| 7,053,314 | B1 | 5/2006 | Camerlo | |
| 7,073,253 | B2 | 7/2006 | Adams et al. | |
| 7,155,815 | B2 * | 1/2007 | Gernhardt et al. | 29/825 |
| 7,246,434 | B1 | 7/2007 | Taylor et al. | |
| 7,347,736 | B2 * | 3/2008 | Ni | 439/660 |
| 7,350,108 | B1 * | 3/2008 | Dean et al. | 714/27 |
| 7,722,406 | B2 * | 5/2010 | Huang | 439/638 |
| 2002/0093803 | A1 | 7/2002 | Olzak et al. | |
| 2003/0232462 | A1 | 12/2003 | Poo et al. | |
| 2006/0000638 | A1 | 1/2006 | Levine et al. | |
| 2006/0194472 | A1 * | 8/2006 | Minich et al. | 439/552 |
| 2008/0265672 | A1 * | 10/2008 | Hong | 307/19 |

OTHER PUBLICATIONS

Partial European Search Report mailed Apr. 8, 2011. In corresponding application No. 10197418.6.
Extended European Search Report mailed Jul. 27, 2011. In corresponding application No. 10197418.6.
QRZ. Printed on Nov. 7, 2011. http://forums.qrz.com/showthread.php?p=1945424. Posted Jul. 2009.
HP Hard Drive Caddy Connector. Printed on Nov. 7, 2011. http://cgi.ebay.com/Hard-Drive-Caddy-Connector-HP-Pavilion-N5000-Laptop-/380231906608?cmd=ViewItem&pt=LH_DefaultDomain_0&hash=item5887967 530 3). Available on ebay as of Jun. 5, 2010.
Solarseller.com Printed on Nov. 7, 2011. "Deep Cycle Battery Post / Terminal Extensions". http://www.solarseller.com/battery_post_extension_marine_terminal_by_quick_cable_.htm. Available as of Jun. 5, 2010.
Ebay.com. Printed on Nov. 7, 2011. http://cgi.ebay.com/0-4-8-GAUGE-BATTERY-TERMINAL-ADAPTER-PLATINUM-488P-/350353164868?cmd=ViewItem&pt=LH_DefaultDomain_0&hash=item5192ad0a44.
SMCelectronics.com. Printed on Nov. 7, 2011. http://www.smcelectronics.com/batthold.htm. Available as of Jun. 5, 2010.

* cited by examiner

*Primary Examiner* — Tuan T Dinh
*Assistant Examiner* — Mukund G Patel
(74) *Attorney, Agent, or Firm* — Novak Druce Connolly Bove + Quigg LLP

(57) ABSTRACT

An adaptive printed circuit board (PCB) connector consists of an adapter. The adapter comprises a printed circuit board having connectors connectable to battery terminals of a battery terminal structure of a populated circuit board (POP) of a mobile device. The adapter can have an opening shaped or adapted to receive the battery terminal structure of the POP. Battery terminals can be spring loaded. Spring loaded battery terminals can provide connective stability between POP and adapter by pushing against edge inside of opening of the adapter.

20 Claims, 10 Drawing Sheets

ADAPTIVE PRINTED CIRCUIT BOARD CONNECTOR

FIELD

The present disclosure relates to mobile devices, and more specifically to a printed circuit board connector for releasably connecting a populated circuit board of a mobile device to a power supply.

BACKGROUND

Mobile devices are becoming more prevalent and more advanced. Mobile devices can include, but are not limited to, cellular telephones, smart telephones, wireless personal digital assistants (PDAs), and laptop computers with wireless 802.11 or Bluetooth capabilities. These devices can run on a wide variety of networks from data-only networks such as Mobitex® and DataTAC® networks to complex voice and data networks such as GSM/GPRS, CDMA, EDGE, UMTS and CDMA2000 networks. As the technology associated with mobile devices continues to advance, users of these mobile devices are becoming more reliant on these mobile devices. In order for mobile devices to be reliable, it is important that their components be tested during manufacture. Many mobile devices comprise populated circuit boards (POP) which draw power from a battery contained within the housing of the device. In order for a POP to be tested and programmed it must be powered. Conventional options for providing power to a POP during testing and programming include placement of the POP into a device's housing. However, a housing may be unavailable and insertion of a POP into a housing and removal of a POP from a housing may be time consuming and potentially damaging to the POP. Conventional options for providing power to a POP during testing and programming also include soldering wires to the power input terminals on a POP, which are connected to a power supply. As is the case with insertion of a POP into a housing and removing a POP from a housing, soldering can be time consuming and potentially damaging to the POP.

BRIEF DESCRIPTION OF THE DRAWINGS

Implementations of the present technology will now be described, by way of example only, with reference to the attached Figures, wherein.

DETAILED DESCRIPTION

Figure 1:
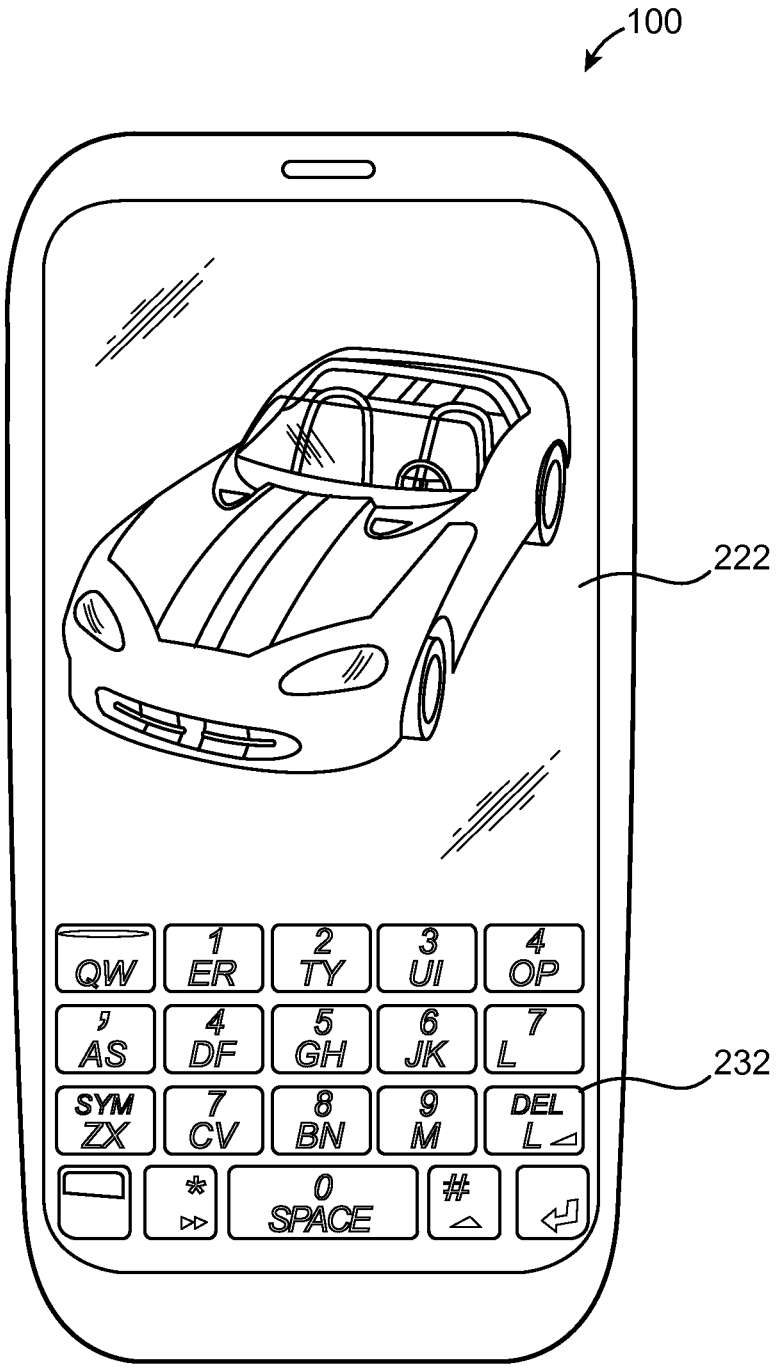
FIG. 1 is a front view of a mobile device having battery connectors in accordance with an example implementation.

As will be appreciated for simplicity and clarity of illustration, where appropriate, reference numerals have been repeated among the different figures to indicate corresponding or analogous elements. In addition, numerous specific details are set forth in order to provide a thorough understanding of the implementations described herein. However, those of ordinary skill in the art will understand that the implementations described herein can be practiced without these specific details. In other instances, methods, procedures and components have not been described in detail so as not to obscure the related relevant feature being described. Also, the description is not to be considered as limiting the scope of the implementations described herein.

Several definitions that apply throughout the disclosure of the technology will now be presented. The word "coupled" is defined as connected, whether directly or indirectly through intervening components, and is not necessarily limited to physical connections. The term "communicatively coupled" is defined as connected, whether directly or indirectly through intervening components, is not necessarily limited to a physical connection, and allows for the transfer of data. The term "mobile device" is defined as any electronic device that is capable of at least accepting information entries from a user and includes the device's own power source. A "wireless communication" means communication that occurs without wires using electromagnetic radiation. The term "memory" refers to transitory memory and non-transitory memory. For example, non-transitory memory can be implemented as Random Access Memory (RAM), Read-Only Memory (ROM), flash, ferromagnetic, phase-change memory, and other non-transitory memory technologies.

The present disclosure describes an adapter for connecting a power supply to the battery terminals of a populated circuit board (POP). The battery terminals can be spring loaded. The adapter comprises a printed circuit board having connectors which can be connected to the battery terminals of a battery terminal structure of a POP. The adapter comprises an extension extending from the PCB and forming an opening between the extension and an edge of the PCB which contains connectors. The opening is shaped or adapted to receive a battery terminal structure of the POP of a mobile device. When the battery terminals are spring loaded, the opening enables the adapter to be removably attached to battery terminal structures having varying form factors. The connectors are coupled to power terminals on the adapter. The power terminals can be connected to a power supply, such as, for example, an extension cord.

Referring to FIG. 1, a front view of a mobile device in accordance with an exemplary implementation is illustrated. The mobile device can house a POP having battery terminals connected to a battery housed within the device. As shown, the mobile device 100 can have a reduced QWERTY keyboard 232. Each key of the keyboard 232 can be associated with at least one indicia representing an alphabetic character, a numeral, or a command (such as a space command, return command, or the like). The plurality of the keys having alphabetic characters can be arranged in a standard keyboard layout. This standard keyboard layout can be a QWERTY layout (as shown in FIG. 1), a QZERTY layout, a QWERTZ layout, an AZERTY layout, a Dvorak layout, a Russian keyboard layout, a Chinese keyboard layout, or other similar layout. These standard layouts are provided by way of example and other similar standard layouts are considered within the scope of the technology. The keyboard layout can be based on the geographical region in which the handheld device is intended for sale. In some examples, the keyboard can be interchangeable such that the user can switch between layouts. In other examples, the keyboard is a virtual keyboard provided on a touch screen display (not shown).

Figure 2:
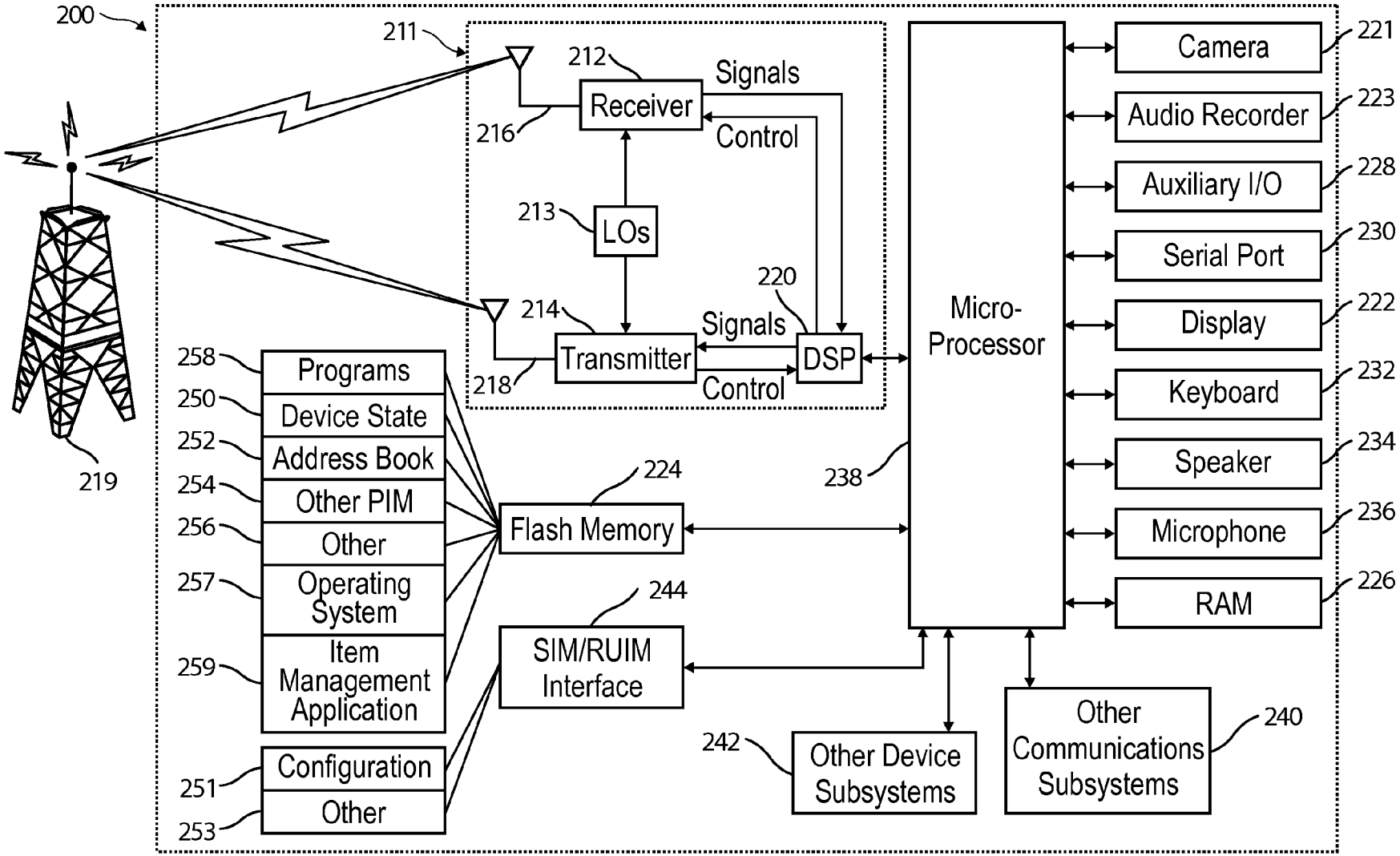
FIG. 2 is a block diagram of a mobile device in a communication network in accordance with an exemplary implementation.

As shown, the exemplary mobile device 100 can be communicatively coupled to a wireless network 219 as exemplified in the block diagram of FIG. 2. These figures are exemplary only, and those persons skilled in the art will appreciate that additional elements and modifications may be necessary to make the mobile device 100 work in particular network environments. In the illustrated implementation, the mobile device 100 is a smart phone, however, in other implementations, the mobile device 100 can be a personal digital assistant (PDA), laptop computer, desktop computer, server, or other mobile device capable of sending and receiving electronic messages.

Referring to FIG. 2, a block diagram of a mobile device in a communication network in accordance with an exemplary implementation is illustrated. As shown, the mobile device 100 can include a microprocessor 238 that controls the operation of the mobile device 100, such as facilitating communications, providing a graphical user interface, executing programs, and so forth. A communication subsystem 311 performs communication transmission and reception with the wireless network 219. The microprocessor 238 further can be coupled with an auxiliary input/output (I/O) subsystem 228 that can be coupled to the mobile device 100. Additionally, in at least one implementation, the microprocessor 238 can be coupled to a serial port (for example, a Universal Serial Bus port) 230 that facilitates communication with other devices or systems via the serial port 330. A display 222 can be communicatively coupled to the microprocessor 238 to facilitate display of information to an operator of the mobile device 100. When the mobile device 100 is equipped with a keyboard 232, which can be physical or virtual (for example, displayed), the keyboard 232 can be communicatively coupled to the microprocessor 238. The mobile device 100 can include one or more speakers 234 and one or more microphones 236, which can advantageously be communicatively coupled to the microprocessor 238 and discussed in further detail below. Other communication subsystems 240 and other mobile device subsystems 242 are generally indicated as communicatively coupled with the microprocessor 238. An example of a communication subsystem 240 is a short-range communication system such as a BLUETOOTH® communication module or a WI-FI® communication module (a communication module in compliance with IEEE 802.11b) and associated circuits and components. Additionally, the microprocessor 238 can perform operating system functions and executes programs or software applications on the mobile device 100. In some implementations, not all of the above components are included in the mobile device 100. The auxiliary I/O subsystem 228 can take the form of one or more different navigation tools (mufti-directional or single-directional), external display devices such as keyboards, and other subsystems capable of providing input or receiving output from the mobile device 100.

The auxiliary I/O subsystem 228 can take the form of a variety of different navigation tools (mufti-directional or single-directional) such as an optical navigation module or tool (not shown). In other implementations, a trackball, thumbwheel, a navigation pad, a joystick, touch-sensitive interface, or other I/O interface can be used. The navigation tool can be located on a front surface of the mobile device 100 or may be located on any exterior surface of the mobile device 100. Other auxiliary I/O subsystems can include external display devices and externally connected keyboards (not shown). While the above examples have been provided in relation to the auxiliary I/O subsystem 228, other subsystems capable of providing input or receiving output from the mobile device 100 are considered within the scope of the technology. Additionally, other keys may be placed along the side of the mobile device 100 to function as escape keys, volume control keys, scrolling keys, power switches, or user programmable keys, and may likewise be programmed accordingly.

As may be appreciated from FIG. 1, the mobile device 100 can have a display 222 located above the keyboard 232 constituting a user input and suitable for accommodating textual input to the mobile device 100. The front face of the mobile device 100 can have a navigation row (not shown). As shown, the mobile device 100 can be of a unibody construction, also known as a "candy-bar" design. In alternate implementations, the mobile device 100 can be a "clamshell" or a "slider" design.

As described above, the mobile device 100 can include the auxiliary input 228 that acts as a cursor navigation tool and which can be also exteriorly located upon the front face of the mobile device 100. The front face location of the navigation tool can allow the navigation tool to be easily thumb-actuable or finger-actuable like the keys of the keyboard 232. An implementation provides the navigation tool in the form of the optical navigation module having one or more sensors, such as a capacitive sensor, optical sensor, or both, which can be utilized to instruct two-dimensional or three-dimensional screen cursor movement in substantially any direction, as well as act as an actuator when the optical navigation module is depressed like a button. The placement of the navigation tool may be above the keyboard 232 and below the display screen 222; here, it can avoid interference during keyboarding and does not block the operator's view of the display screen 222 during use, for example, as shown in FIG. 1.

The mobile device 100 can be configured to send and receive messages. The mobile device 100 includes a body or housing which can, in some implementations, be configured to be held in one hand by an operator of the mobile device 100 during text entry. The display 222 is included which is located on the front face of the body and upon which information is displayed to the operator during text entry. The mobile device 100 can also be configured to send and receive voice communications such as mobile telephone calls. The mobile device 100 can also include a camera 221 to allow the user to take electronic photographs which can be referred to as photos or pictures.

The mobile device 100 can be equipped with components to enable operation of various programs, as shown in FIG. 2. As shown, the memory 224 can provide storage for the operating system 250, device programs 258, data, and so forth. The operating system 250 can be generally configured to manage other programs 258 that are also stored in memory 224 and executable on the processor 238. The operating system 250 can handle requests for services made by programs 258 through predefined program 258 interfaces. More specifically, the operating system 250 can typically determine the order in which multiple programs 258 are executed on the processor 238 and the execution time allotted for each program 258, manages the sharing of memory 224 among multiple programs 258, handles input and output to and from other device subsystems 342, and so forth. In addition, operators can interact directly with the operating system 250 through a user interface, typically including the keyboard 232 and display screen 222. The operating system 250, programs 258, data, and other information can be stored in memory 224, RAM 226, read-only memory (ROM), or another suitable storage element (not shown). An address book 252, personal information manager (PIM) 254, and other information 256 can also be stored.

The mobile device 100 can be enabled for two-way communication within voice, data, or voice and data communication systems. A Subscriber Identity Module (SIM) or Removable User Identity Module (RUIM) can be utilized to authorize communication with the communication network 219. A SIM/RUIM interface 244 within the mobile device 100 can interface a SIM/RUIM card to the microprocessor 238 and facilitates removal or insertion of a SIM/RUIM card (not shown). The SIM/RUIM card features memory and can hold key configurations 251, and other information 253 such as identification and subscriber related information. The mobile device 100 can be equipped with an antenna 218 for transmitting signals to the communication network 219 and another antenna 216 for receiving communication from the communication network 219. Alternatively, a single antenna (not shown) can be utilized to transmit and receive signals. A communication subsystem 211 can include a transmitter 214 and receiver 212, one or more antennae 216, 218, local oscillators (LOs) 213, and a processing module 220 such as a digital signal processor (DSP) 220.

The mobile device 100 can include a touch-sensitive display or touchscreen 224 that includes one or more touch location sensors, an overlay, and a display 222, such as a liquid crystal display (LCD) or light emitting diode (LED) display, such as shown in FIG. 2. The touch location sensor(s) can be a capacitive, resistive, infrared, surface acoustic wave (SAW), or other type of touch-sensitive sensor and can be integrated into the overlay. The overlay, or cover, can be comprised of laminated glass, plastic, or other suitable material(s) and is advantageously translucent or transparent. A touch, or touch contact, can be detected by a touchscreen and processed by the processor 238, for example, to determine a location of the touch. Touch location data can include the center of the area of contact or the entire area of contact for further processing. A touch may be detected from a contact member, such as a body part of a user, for example a finger or thumb, or other objects, for example a stylus, pen, or other pointer, depending on the nature of the touch location sensor.

Figure 3:
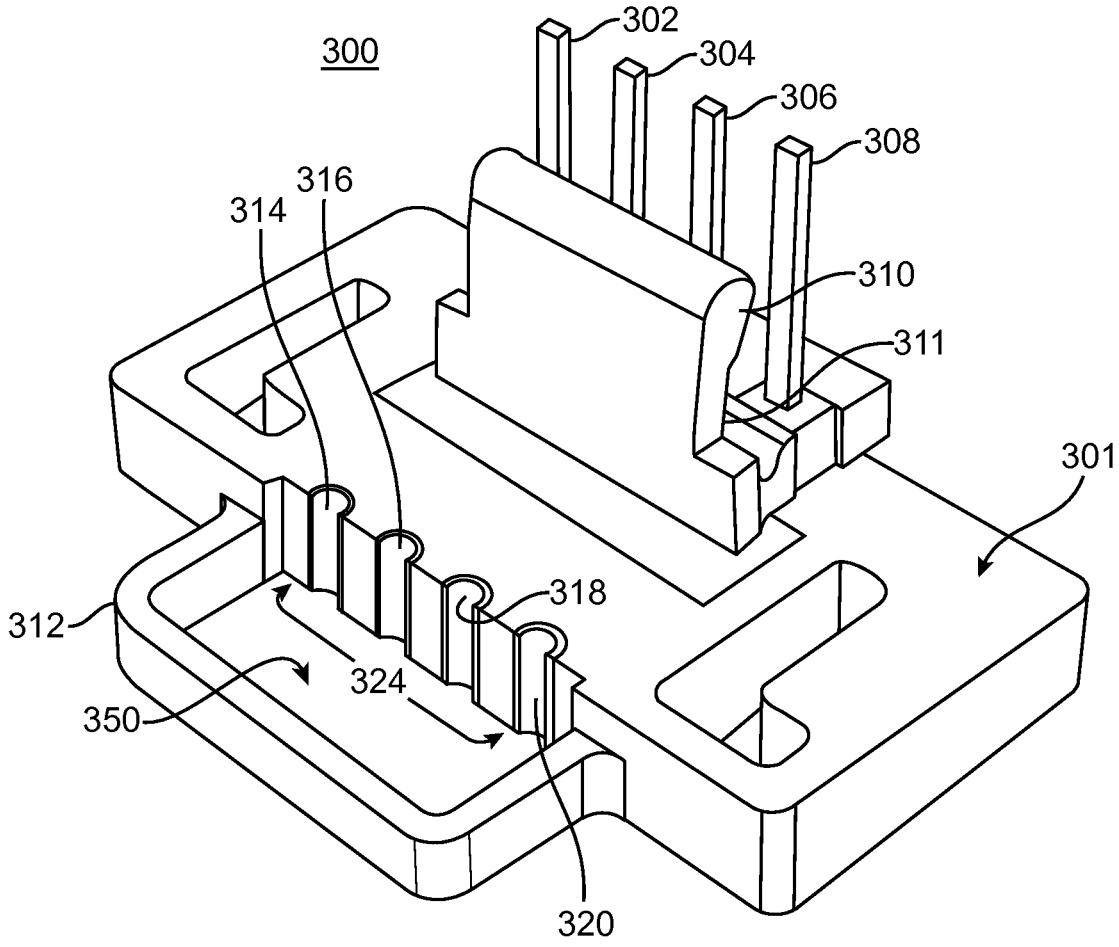
FIG. 3 is a perspective view of a PCB adaptive connector for a POP of a mobile device in accordance with an exemplary implementation.

Referring to FIG. 3, a perspective view of an adapter 300 containing a PCB 301 in accordance with an exemplary implementation is illustrated. As shown, the adapter 300 can include an extension 312 which forms an opening 350 between the extension 312 and an edge of the adapter 300. The edge of the adapter 300 contains connectors 314, 316, 318 and 320. As will be further describe below, the connectors are electrically coupled to power terminals 302, 304, 306 and 308. The shape of the connectors 314, 316, 318 and 320 makes the suitable to receive the battery terminals of the POP. If the battery terminals are spring loaded, when the battery terminal structure of the POP is placed within the opening 350, the battery terminals can apply a mechanical force to the connectors 314, 316, 318 and 320. The mechanical force is communicated to the extension 312 which presses against the side of the terminal structure opposite the side of the terminal structure containing the battery terminals. The mechanical force applied by the battery terminals and the mechanical force applied by the extension provides stability to maintain keep the adapter 300 in place and thereby maintain electrical connectivity between the POP and a power supply during testing or programming of the POP or testing and programming of the POP. The adapter 300 can include a clip 311 having an expanded lip 310. The clip 311 can be made from a resilient material such as plastic. Depending on the shape and configuration of the clip 311, the clip 311 can be used to removably attach the adapter 300 to a power supply in conjunction with the power terminals 302, 304, 306 and 308.

Figure 4:
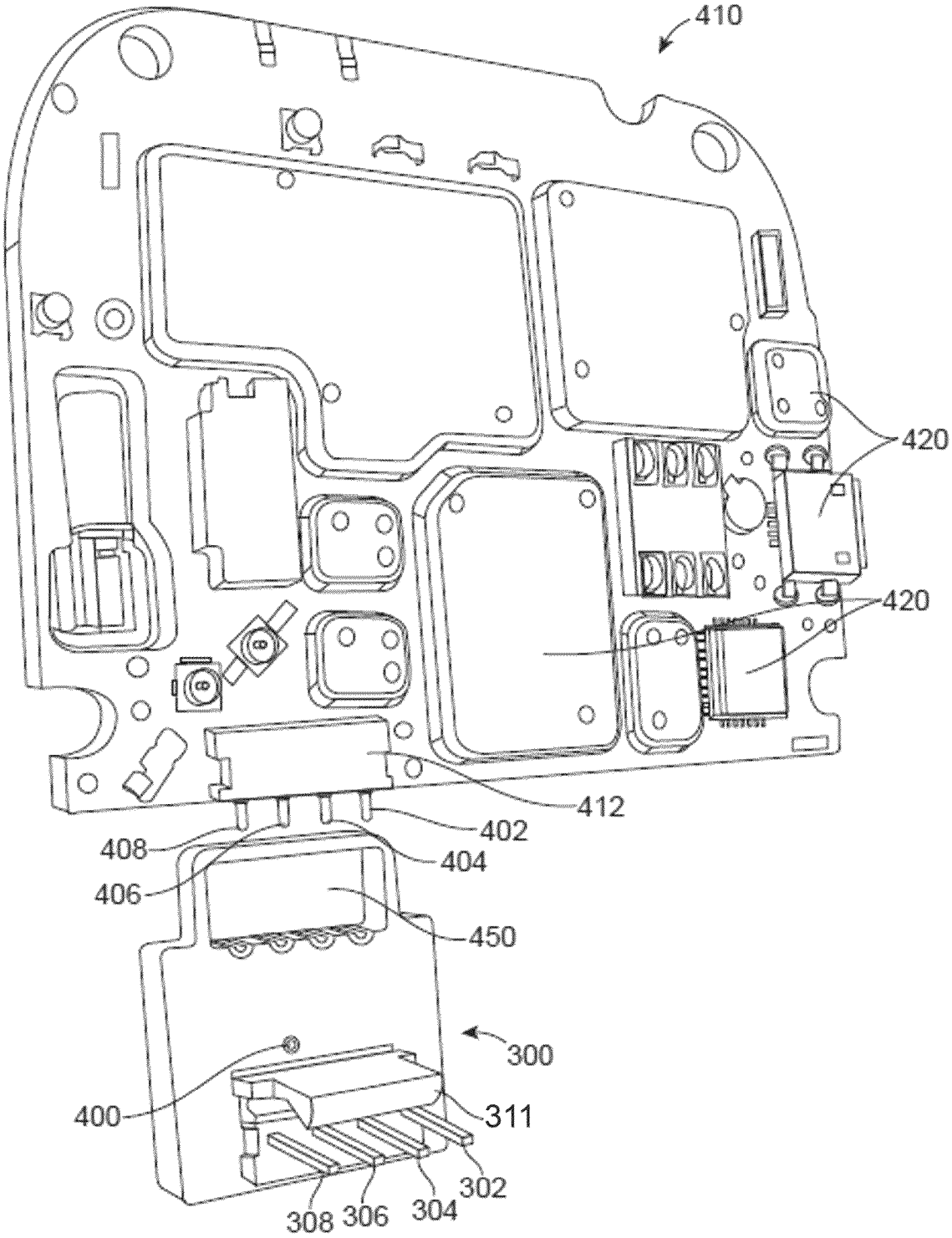
FIG. 4 is a perspective view of a PCB adaptive connector adjacent to a POP of a mobile device in accordance with an exemplary implementation.

Referring to FIG. 4, a perspective view of an adapter 300 and a POP 410 comprising a battery terminal structure 412 in accordance with an exemplary implementation are illustrated. The battery terminal structure 412 contains battery terminals 402, 404, 406 and 408, which, as described above, can be spring loaded. The POP 410 is populated with various components, for example, 420. The various components 420 can be coupled to one another and coupled to a power supply through the battery terminals and through the adapter 300. The adapter 300 illustrated in FIG. 4 contains a via 400 which connects conductive material near the bottom surface of the adapter 300 with conductive material near the top surface of the adapter through which at least one of the connectors 314, 316, 318 and 320 is electrically connected to at least one of the power terminals, 302, 304, 306 and 308.

Figure 5:
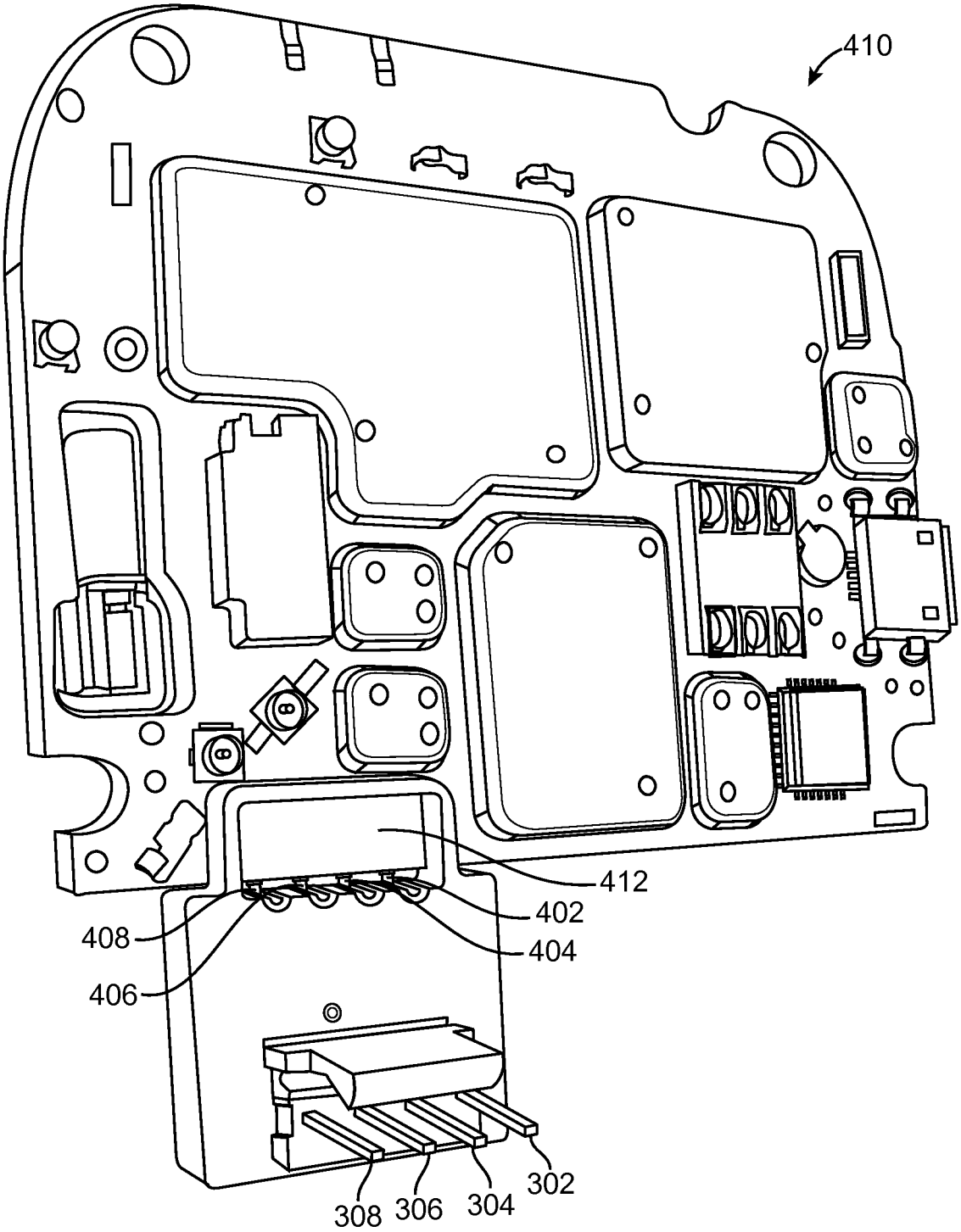
FIG. 5 is a perspective view of a PCB adaptive connector connected to the battery terminals of a POP of a mobile device in accordance with an exemplary implementation.

Referring to FIG. 5, a perspective view of an adapter 300 connected to a battery terminal structure 412 of a POP 410 in accordance with an exemplary implementation is illustrated. The battery terminal structure 412 can be seen to reside within the opening 350 of the adapter 300. The battery terminals 402, 404, 406 and 408 can be seen to be in contact with the connectors 314, 316, 318 and 320 of the adapter 300. As described above, if the battery terminals 402, 404, 406 and 408 are spring loaded they can apply a mechanical force to the connectors 314, 316, 318 and 320 of the adapter 300.

Figure 6:
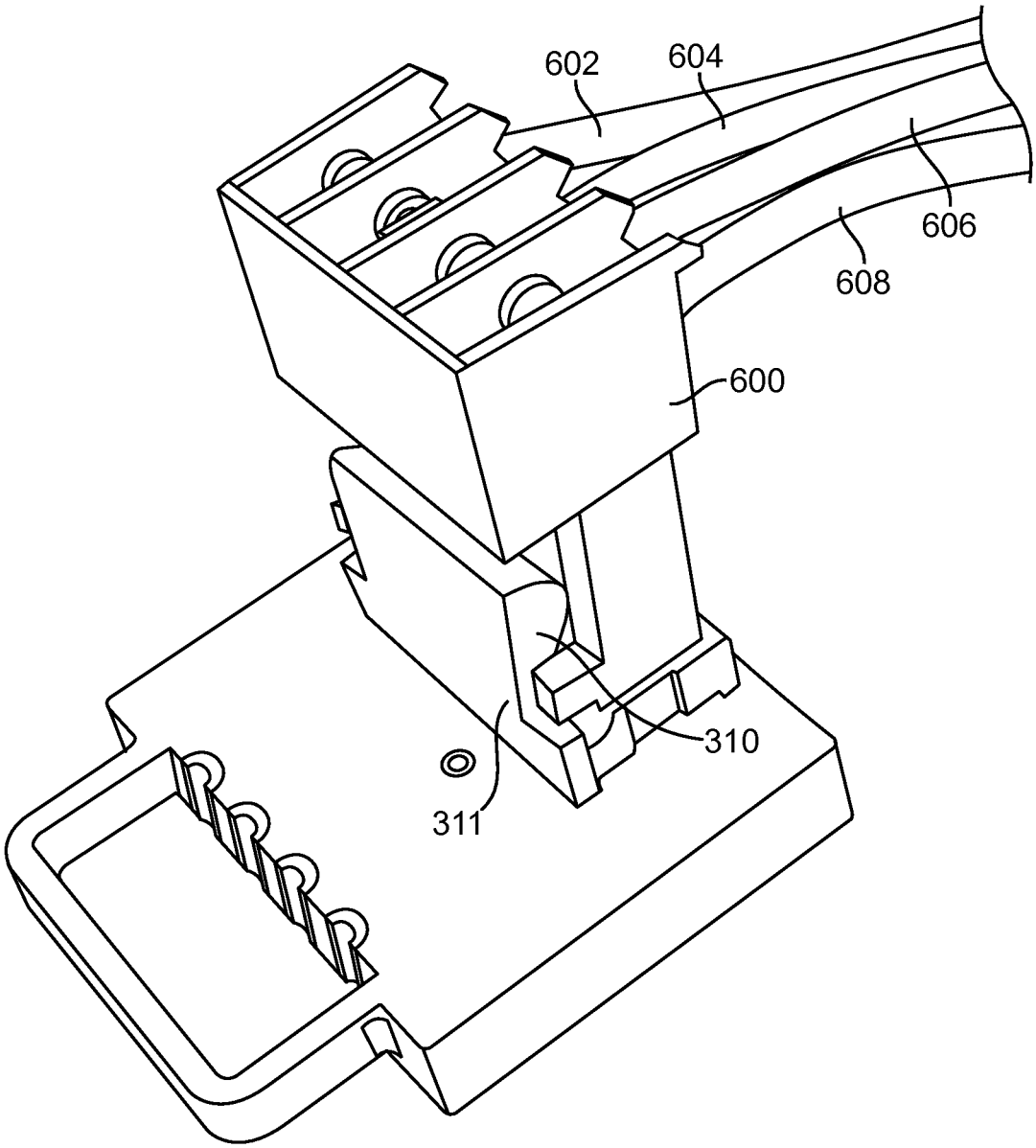
FIG. 6 is a perspective view of a PCB adaptive connector connected to a power supply in accordance with an exemplary implementation.

Referring to FIG. 6, a perspective view of an adapter 300 connected to a power supply 600 in accordance with an example implementation is illustrated. Inside the power supply 600, the power terminals 302, 304, 306 and 308 are coupled to conductive material within power supply leads 602, 604, 606 and 608. The lip 310 of the clip 311 of the adapter 300 can apply a mechanical force against the power supply 600. The mechanical force applied against the power supply 600 can be communicated to the power terminals 302, 304, 306 and 308, thus providing stability to the connection between the adapter 300 and the power supply 600, and thus maintaining connectivity between the power supply 600 and the POP 410.

Figure 7:
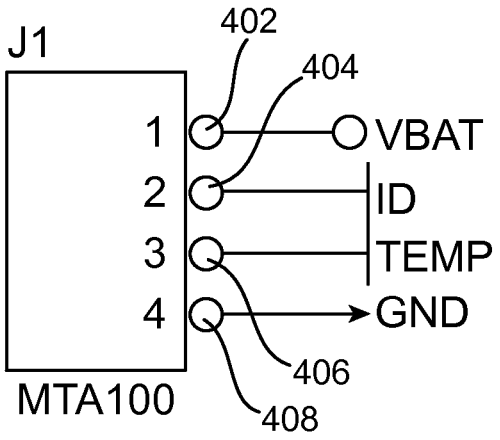
FIG. 7 is a schematic view of a battery terminal structure of a POP in accordance with an exemplary implementation.

Referring to FIG. 7, a schematic view of a battery terminal structure 412 in accordance with an example implementation is illustrated. In the implementation illustrated battery terminal 402 corresponds to a voltage connection, VBAT, battery terminal 404 corresponds to an ID connection, battery terminal 406 corresponds to a TEMP connection and battery terminal 408 corresponds to a ground connection. Those skilled in the art will recognize that other configurations aside from the one illustrated in FIG. 7 are possible within the technology.

Figure 8:
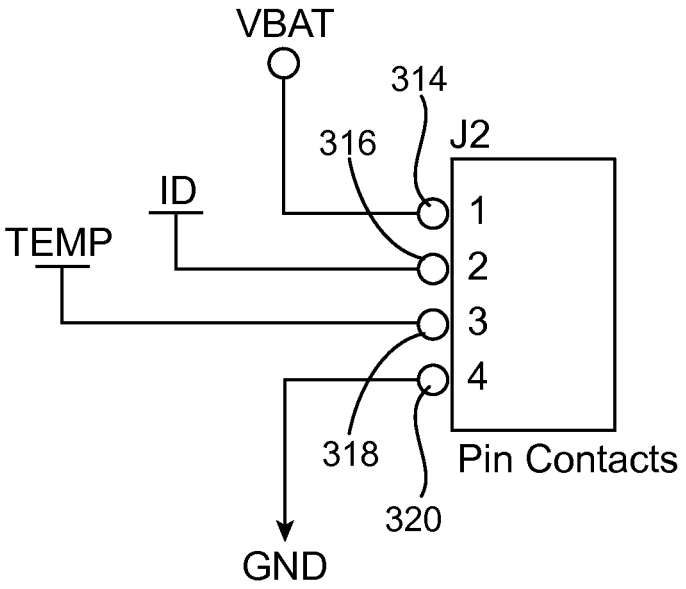
FIG. 8 is a schematic view of a PCB adaptive connector in accordance with an exemplary implementation.

Referring to FIG. 8, a schematic view of an adapter 300 in accordance with an example implementation is illustrated. In the implementation illustrated connector 314 corresponds to a voltage connection, VBAT, connector 316 corresponds to an ID connection, connector 318 corresponds to a TEMP connection and connector 320 corresponds to a ground connection. Those skilled in the art will recognize that other configurations aside from the one illustrated in FIG. 8 are possible within the technology.

Figure 9:
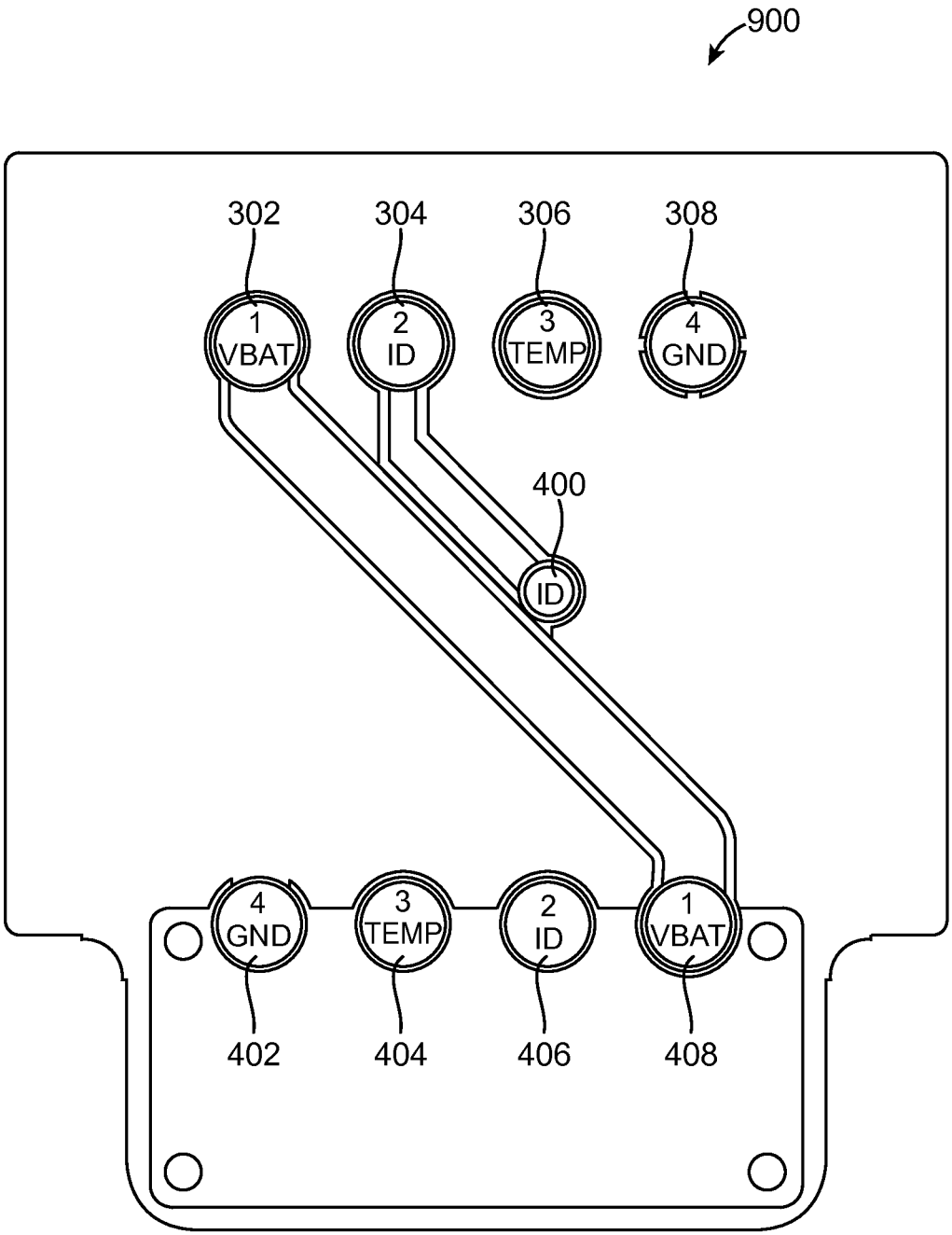
FIG. 9 is a schematic top view of a PCB adaptive connector connected to the battery terminals of a POP of a mobile device in accordance with an exemplary implementation.

Referring to FIG. 9, a schematic top view 900 of an adapter 300 in accordance with an example implementation is illustrated. FIG. 9 illustrates possible electrically connective paths between the battery terminals 406, 408, and power terminals 304, 302, respectively. Battery terminal 402 and power terminal 308 are connected to ground. Those skilled in the art will recognize that other configurations aside from the one illustrated in FIG. 9 are possible within the technology.

Figure 10:
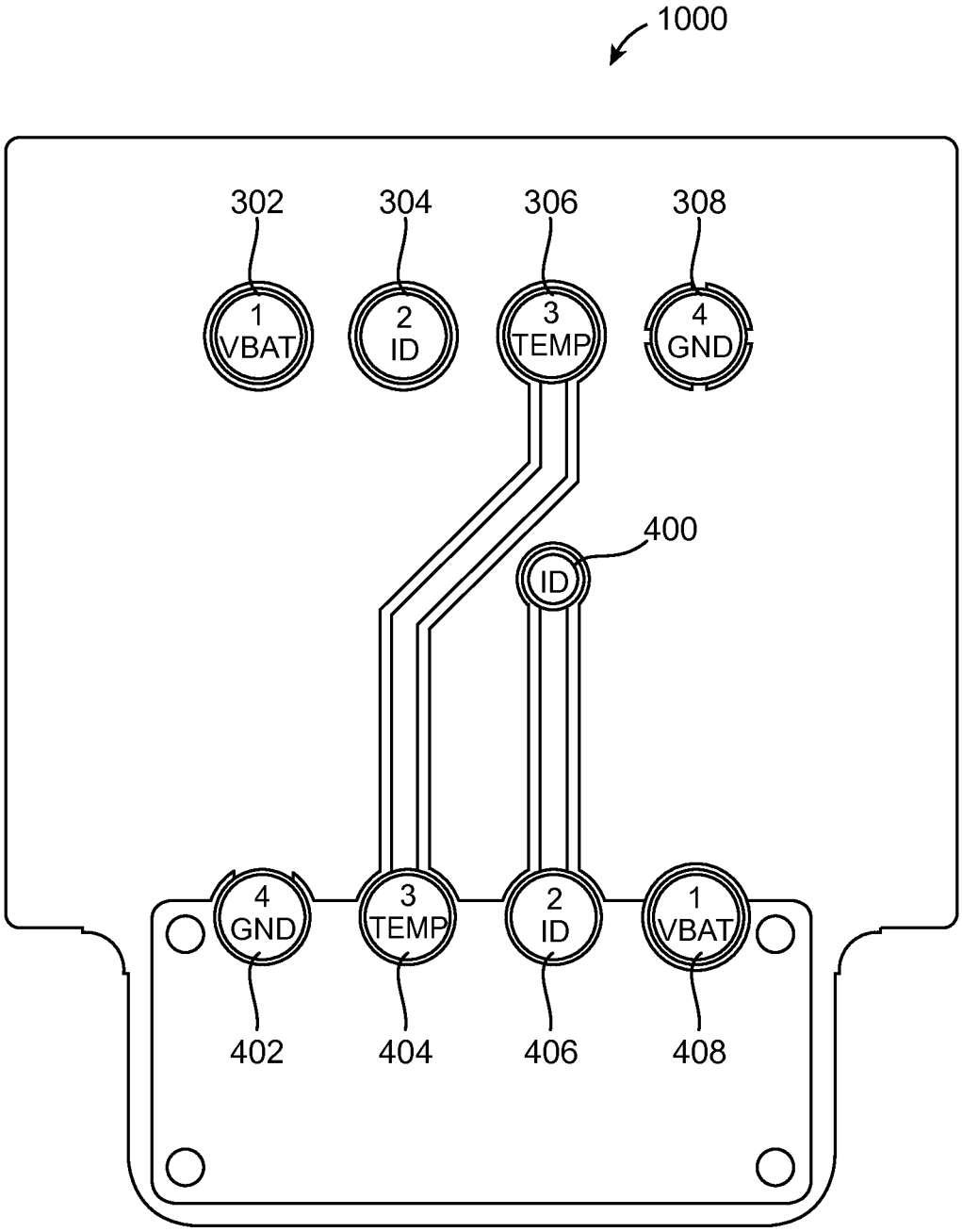
FIG. 10 is a schematic bottom view of a PCB adaptive connector connected to the battery terminals of a POP of a mobile device in accordance with an exemplary implementation.

Referring to FIG. 10, a schematic bottom view 1000 of an adapter 300 in accordance with an example implementation is illustrated. FIG. 10 illustrates possible electrically connective paths between the battery terminals 404, 406, and power terminals 306, 304, respectively. Again, Battery terminal 402 and power terminal 308 are connected to ground. Those skilled in the art will recognize that other configurations aside from the one illustrated in FIG. 10 are possible within the technology.

Figure 11:
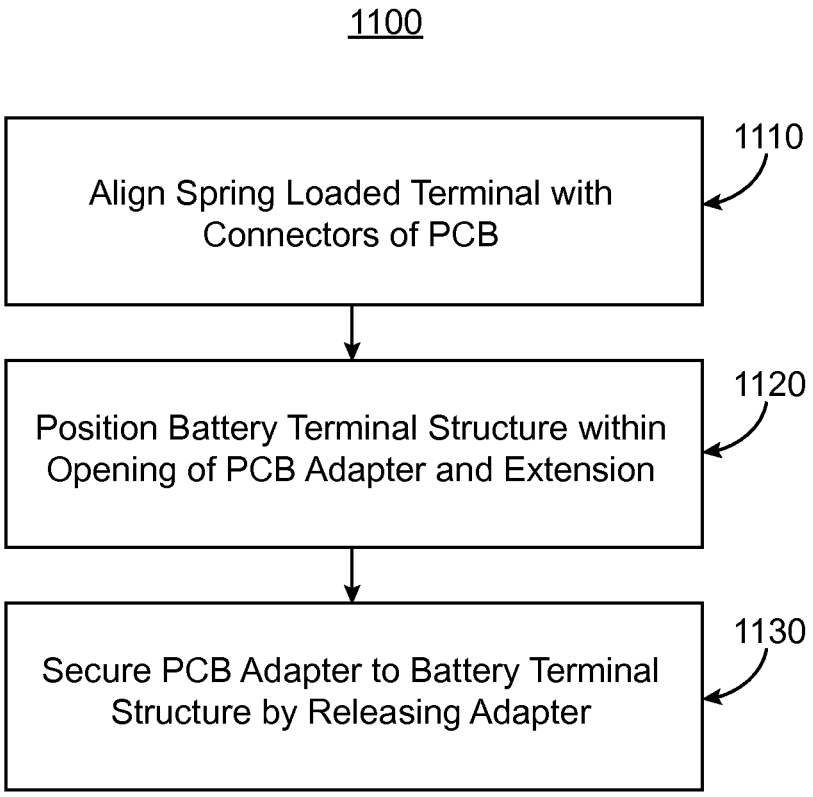
FIG. 11 is a flowchart of a method in accordance with an exemplary implementation.

Referring to FIG. 11, a flowchart of steps of a method 1100 within the technology is illustrated. The method includes aligning spring loaded battery terminals comprised within a battery terminal structure of the mobile device with connectors which are coupled to an edge of the adapter 1110. The method further includes positioning the battery terminal structure in an opening between the PCB 301 and an extension extending from the PCB 301 while the spring loaded battery terminals are compressed against the connectors 1120. The method further included securing the adapter to the battery terminal structure by releasing the adapter such that the spring loaded terminals secure the battery terminal structure between the extension and the connectors 1130.

The technology may be implemented in other specific forms without departing from its essential characteristics. The described implementations are to be construed in all respects only as illustrative and not restrictive. The scope of the technology is, therefore, indicated by the appended claims rather than by the foregoing description. All changes that come within the meaning and range of equivalency of the claims are to be embraced within their scope.

The invention claimed is:

1. An adapter comprising:

a printed circuit board (PCB) having a first edge;

power terminals electrically coupled to the PCB;

a plurality of recesses formed in the first edge of the PCB, configured and spaced along the first edge to correspond to a battery interface of a populated circuit board for use in a mobile device; and a plurality of connectors formed within the recesses, separated from one another by a non-conductive portion of the PCB, and electrically coupled to the power terminals such that, when the plurality of connectors are connected to the populated circuit board in place of a battery and when a power source is connected to the power terminals, power is provided to the populated circuit board of the mobile device via the PCB as if the battery was inserted in the battery interface.

2. The adapter of claim 1, further comprising an extension extending from the PCB and forming an opening between the extension and the first edge of the PCB.

3. The adapter of claim 2, wherein the plurality of connectors are configurable to provide support to enable spring loaded battery terminals to be compressed against the plurality of connectors and wherein the extension assists in securing the adapter to the battery terminal structure of the mobile device.

4. The adapter of claim 2, wherein the extension extends from the first edge of the PCB.

5. The adapter of claim 1, wherein the power terminals are configurable to provide power to the mobile device when the adapter is secured to the battery interface of the mobile device and an active power source is coupled to the power terminals of the PCB.

6. The adapter of claim 1, wherein the power terminals are orthogonal to a top surface of the PCB.

7. The adapter of claim 1, wherein the plurality of connectors are castellated vias.

8. The adapter of claim 7, wherein the castellated vias comprise copper material.

9. The adapter of claim 1, wherein each of the plurality of connectors is a half-pipe with an opening of the half pipe running orthogonally to a top surface of the PCB.

10. The adapter of claim 1, wherein at least one of the plurality of connectors is a ground connector.

11. The adapter of claim 1, further comprising a clip proximate the power terminals.

12. The adapter of claim 11, wherein the adapter is configured to be releasably attached by the clip to a power supply.

13. The adapter of claim 11, wherein the clip is composed of a resilient material.

14. The adapter of claim 13, wherein the resilient material is one of plastic, vinyl or latex.

15. The adapter of claim 1, wherein each of the plurality of connectors comprises a cavity adapted to receive terminals of the battery.

16. A method comprising:

aligning spring loaded battery terminals comprised within a battery terminal structure of a populated circuit board for use in a mobile device, with connectors coupled to a first edge of a printed circuit board (PCB) of an adapter, a plurality of recesses formed in the first edge of the PCB, the connectors being formed within corresponding recesses separated from one another by a non-conductive portion of the PCB and being electrically coupled to power terminals, the connectors being configured and spaced along the first edge of the PCB to correspond to a battery interface of the populated circuit board;

positioning the battery terminal structure in an opening between the PCB and an extension extending from the PCB while the spring loaded battery terminals are compressed against the connectors; and securing the adapter to the battery terminal structure by releasing the adapter such that the spring loaded terminals secure the battery terminal structure between the extension and the connectors such that, when an active non-battery power source is connected to the adapter and the adapter is secured to the battery terminal structure, power is provided to the populated circuit board via the adapter as if a battery was connected to the battery terminal structure.

17. The method of claim 16, further comprising engaging a power supply connector to the power terminals coupled to the PCB, the power terminals being electrically coupled to the connectors.

18. The method of claim 17, further comprising activating the non-battery power source via an external power supply to power the populated circuit board.

19. The method of claim 18, further comprising deactivating the non-battery power source turning off external the power supply.

20. The method of claim 19, further comprising removing the adapter from the battery terminal structure by compressing the connectors against the spring loaded battery terminals.

* * * * *